US007231798B2

(12) United States Patent
Zhang et al.

(10) Patent No.: US 7,231,798 B2
(45) Date of Patent: Jun. 19, 2007

(54) SYSTEM AND METHOD FOR TUBE BENDING

(75) Inventors: Wenwu Zhang, Schenectady, NY (US); Marshall Gordon Jones, Scotia, NY (US); David Peter Mika, Clifton Park, NY (US); Brian Harlow Farrell, Amsterdam, NY (US); Michael Evans Graham, Slingerlands, NY (US); Judson Sloan Marte, Wynantskill, NY (US); Magdi Naim Azer, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 52 days.

(21) Appl. No.: 11/170,360

(22) Filed: Jun. 29, 2005

(65) Prior Publication Data

US 2006/0065035 A1 Mar. 30, 2006

Related U.S. Application Data

(60) Provisional application No. 60/614,334, filed on Sep. 29, 2004.

(51) Int. Cl.
*B21D 37/16* (2006.01)

(52) U.S. Cl. ..... 72/342.5; 72/17.3; 72/69; 72/128; 72/342.6; 72/369

(58) Field of Classification Search ..... 72/17.3, 72/37, 38, 54, 56, 69, 128, 342.1, 342.5, 72/342.6, 342.94, 364, 369; 219/643, 652, 219/59.1, 61.4, 121.73, 121.78
See application file for complete search history.

(56) References Cited

U.S. PATENT DOCUMENTS 1,888,891 A * 11/1932 Schmidt ..... 72/57

(Continued)

FOREIGN PATENT DOCUMENTS

GB 1292174 10/1972

(Continued)

OTHER PUBLICATIONS

W. Zhang et al., "Laser Forming: Industrial Application," Proceedings of the 23rd Int'l Congress on Applications of Laser and Electro-Optics 2004, Oct. 2004, pp. 1-9.

(Continued)

*Primary Examiner*—Ed Tolan
(74) *Attorney, Agent, or Firm*—Penny A. Clarke; Patrick A. Patnode

(57) ABSTRACT

A method for bending a tube in a pre-selected geometry includes deriving at least one processing parameter from the geometry, applying a thermal source circumferentially to the tube to heat the tube along at least one circumferentially directed path in accordance with the parameter and actively cooling the tube to a pre-selected temperature. The applying and active cooling steps are alternately performed a number of times. A system for bending the tube includes a thermal source for heating at least one region along the path on the tube, a tube advancing module for advancing the tube, an active cooling module for cooling the tube to a pre-selected temperature, a processing module to derive at least one processing parameter from the geometry and a control module configured to control the thermal source and active cooling module in accordance with the parameter. The alternate heating and cooling are performed a number of times.

34 Claims, 9 Drawing Sheets

U.S. PATENT DOCUMENTS

| | | | | |
|---|---|---|---|---|
| 2,428,825 | A * | 10/1947 | Arnoldy | 148/642 |
| 3,368,377 | A * | 2/1968 | Atsuo et al. | 72/128 |
| 4,007,616 | A * | 2/1977 | Aleck | 72/38 |
| 4,727,641 | A * | 3/1988 | Kanatani et al. | 29/447 |
| 5,135,695 | A | 8/1992 | Marcus | |
| 5,233,150 | A | 8/1993 | Schneebeli et al. | |
| 5,359,872 | A | 11/1994 | Nashiki | |
| 5,713,130 | A * | 2/1998 | Fukuda et al. | 29/897.3 |
| 6,178,798 | B1 * | 1/2001 | Kowalski et al. | 72/200 |
| 6,339,205 | B1 | 1/2002 | Nakayama | |
| 6,622,540 | B2 | 9/2003 | Jones et al. | |
| 2004/0118158 | A1 | 6/2004 | Schwertfeger et al. | |

FOREIGN PATENT DOCUMENTS

| | | |
|---|---|---|
| JP | 1313113 | 12/1989 |
| JP | 5177366 | 7/1993 |
| JP | 2002-2219587 | 8/2002 |

OTHER PUBLICATIONS

J. Zhang et al., "Effects of scanning Schemes on Laser Tube Bending," Proceedings of the 23rd Int'l Congress on Applications of Laser and Electro-Optics 2004, Oct. 2004, pp. 1-10.

R. Kuckuck, "ES and H. Manual," vol. II, Part 20, Document 20.8, May 2000, Pages cover and 14-16.

Glove Box Technology, "Welcome to Glove Box Technology, LTD." www.glovebox.co.uk, copyright 2004, 4 pages.

F. Vollersten, "Mechanisms and Models for Laser Forming," Laser Assisted net Shape Engineering proceedings of the Lane '94, vol. I, pp. 345-360.

EP 05254271, EP Search Report, Dec. 19, 2005.

* cited by examiner

SYSTEM AND METHOD FOR TUBE BENDING

CROSS REFERENCE TO RELATED APPLICATION

This application claims the benefit of U.S. Provisional Application No. 60/614,334, filed Sep. 29, 2004.

STATEMENT REGARDING FEDERALLY SPONSORED RESEARCH & DEVELOPMENT

This invention was made with Government support under contract number 70NANB2H3031 awarded by the National Institute for Standards and Technology ("NIST"). The Government has certain rights in the invention.

BACKGROUND

The invention relates generally to manufacturing processes for tube bending and, more particularly, to laser tube bending.

Presently, mechanical bending techniques are generally used to bend tubes. Although mechanical tube bending systems can bend tubes quickly with acceptable radius control, these systems have a number of limitations. For example, mechanical bending usually requires dedicated fixtures, thereby increasing the expense of the process. Mechanical bending often causes thinning along the outside arc of the bend radius (the extrados), thereby necessitating in many cases the use of a heavier tube than would otherwise be required. In addition, mechanical bending around large radii often causes cross-section distortion, which reduces the cross sectional area of the bent tube (important if the tube is to carry a gas or fluid), as well as reducing rigidity. In addition it is difficult to create contiguous (one after another) or compound (out of plane) bends using mechanical bending techniques. Contiguous bends are difficult because bending dies by their nature often have inherent minimal requirements for straight sections before and after the bend. Out of plane bends are also limited to applications with specialty tooling. These restrictions are typically overcome by cutting segments of bent pipe and bonding to form the desired configuration—steps that add to manufacturing complexity, time and cost. Hydroforming has been applied to tube forming to alleviate some of the drawbacks of traditional mechanical bending, but the advantages are offset by high equipment costs and specialized tooling.

As an alternative to mechanical bending, thermal energy can be used to bend tubes. Thermal tube bending imparts permanent deformations and is a non-contact process that is free from the use of dies and the concomitant constraints of the mechanical countertype. The thermal mechanism employed is typically referred to as an "upsetting" mechanism that contracts or gathers (hence the term "upset") material at the point of heating. The judicious application of heating over large areas will shape the workpiece in a desired fashion, allowing for example tube sections to be formed into a variety of shapes.

The mechanism of thermal upsetting can be described as follows: consider a thin plate or sheet of material that expands upon heating, as do most engineering materials such as metals, thermoplastics, etc. If a heat source is applied to a region of the plate such that a small temperature gradient perpendicular to the surface is produced—i.e. the temperature is nearly constant through the thickness—a compressive stress will begin to develop in the plane of the sheet—given that buckling is not introduced—due to the thermal expansion of the heated material. At first, only elastic deformations are present, and if the thermal excursion is gentle enough, upon cooling, the plate will return to its original planar shape. If however the thermal energy continues to be applied—baring melting—the in-plane compressive stresses will yield the material and it will begin to plastically flow in compression in the plane of the plate. Because the through-thickness thermal gradient is very low, the plastic flow will be nearly homogenous in the thickness direction. During cooling the heated region will contract, and after complete cooling the region will exhibit a net contraction in the plane orientation and a net expansion in the thickness orientation due to the plastic flow. The mechanism can be effectively applied with moving heat sources (resulting in a predominant contraction transverse to the heating line) with various geometries. Any of a number of thermal energy sources may be used such as laser, induction, resistance, plasma, etc.

In laser tube bending, laser energy is usually scanned across the inside arc of the intended bend (the intrados) to heat the tube. The tube then is allowed to cool. The thermal stress causes plastic thickening and contraction of the scanned region as described above, while the opposing side maintains its original length, thereby causing the tube to bend toward the scanned region. Under favorable conditions, laser tube bending maintains both the outside arc thickness and tube cross section. Laser tube bending also minimizes the need for hard tooling, which can reduce costs and lead times significantly and permits users to create complex combinations or configurations of bends including out-of-plane or three-dimensional (3D) bends that would otherwise be prohibitively expensive to make by traditional methods.

Laser tube bending can be performed using either a rotational or an axial application of energy. For axial scanning, a specially shaped laser beam is directed along the axis of the tube. Axial scanning is generally suitable for large radius tube bending. For the rotational approach, laser energy is applied in the tube's circumferential direction at discrete intervals.

In addition, the rotational approach may be used for large radius tube bending but may be slower than axial tube bending. Usually, axial scanning is faster than rotational scanning. However, with axial scanning it can be difficult to control surface damage, in addition to being difficult to achieve small bending radii. Axial scanning is also particularly sensitive to the processing window and cooling of the tube. Beneficially, rotational tube bending provides improved, localized control of the bending, thereby providing improved accuracy. However, current rotational tube bending methods are quite slow.

It would therefore be desirable to provide a system and method for laser tube bending that have enhanced robustness and greater speed relative to existing systems and methods.

BRIEF DESCRIPTION

Briefly, one aspect of the present invention resides in a method for bending a tube in a pre-selected geometry. The method includes deriving at least one processing parameter from the pre-selected geometry, applying a thermal source circumferentially to the tube to heat the tube along at least one circumferentially directed path in accordance with the at least one processing parameter and actively cooling the tube to a pre-selected temperature. The applying and active cooling steps are alternately performed a number of times to heat the tube along the circumferentially directed path and to repeatedly actively cool the tube to the pre-selected temperature.

Another aspect of the invention resides in a system for bending a tube in a pre-selected geometry. The system includes a thermal source configured for heating at least one region along a circumferentially directed path on the tube, a tube advancing module for advancing the tube, an active cooling module configured for cooling the tube to a pre-selected temperature, a processing module configured to derive at least one processing parameter from the pre-selected geometry, and a control module configured to control the thermal source and active cooling module in accordance with the at least one processing parameter to alternately heat the tube along the circumferentially directed path and to cool the tube to the pre-selected temperature, wherein the alternate heating and cooling are performed a number of times.

DRAWINGS

These and other features, aspects, and advantages of the present invention will become better understood when the following detailed description is read with reference to the accompanying drawings in which like characters represent like parts throughout the drawings, wherein:

FIG. 1 schematically shows a system for tube bending, in accordance with one embodiment of the invention;

DETAILED DESCRIPTION

Figure 6:
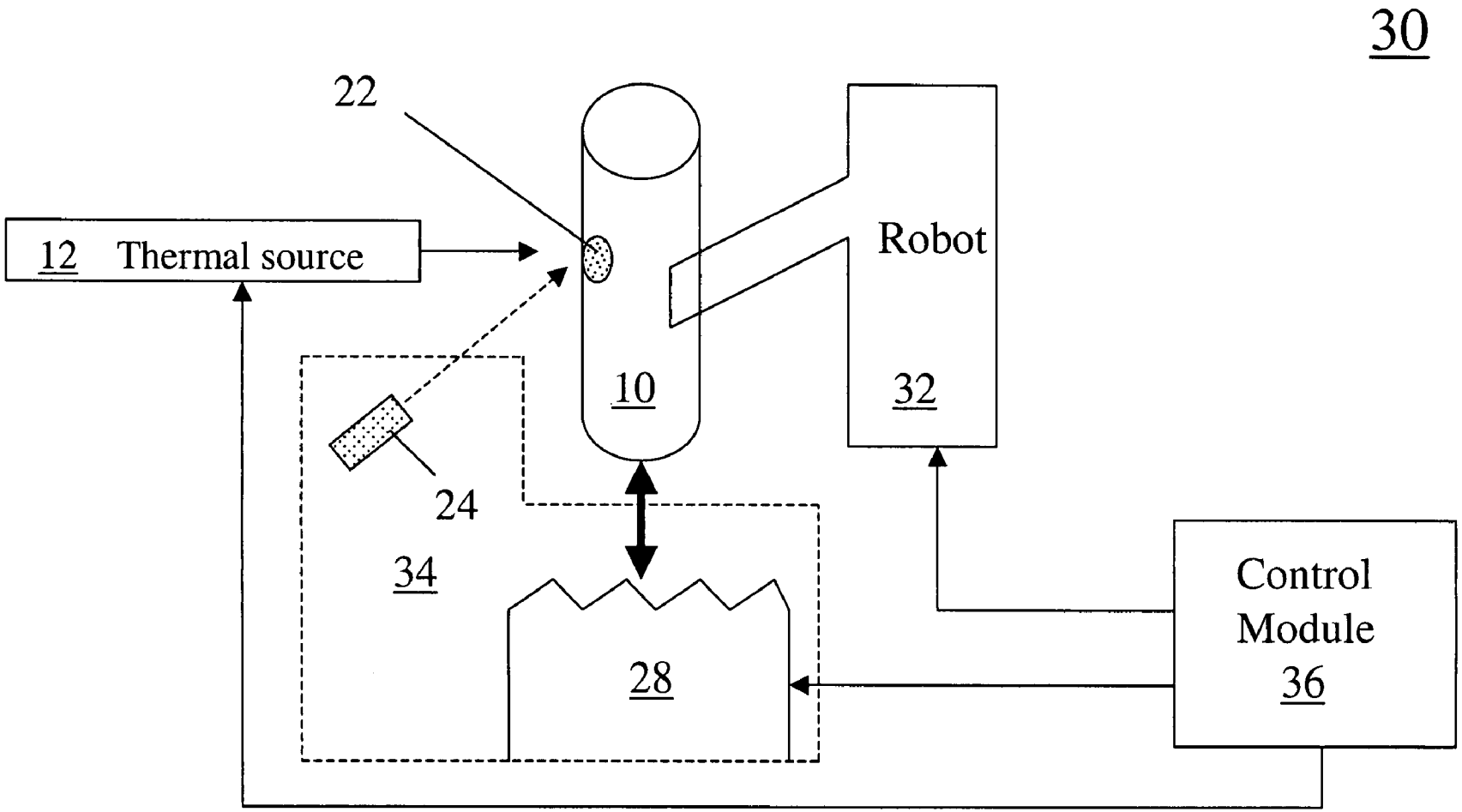
FIG. 6 illustrates one active cooling embodiment of the invention that incorporates both quench cooling and intermittent liquid spray cooling.
Figure 7:
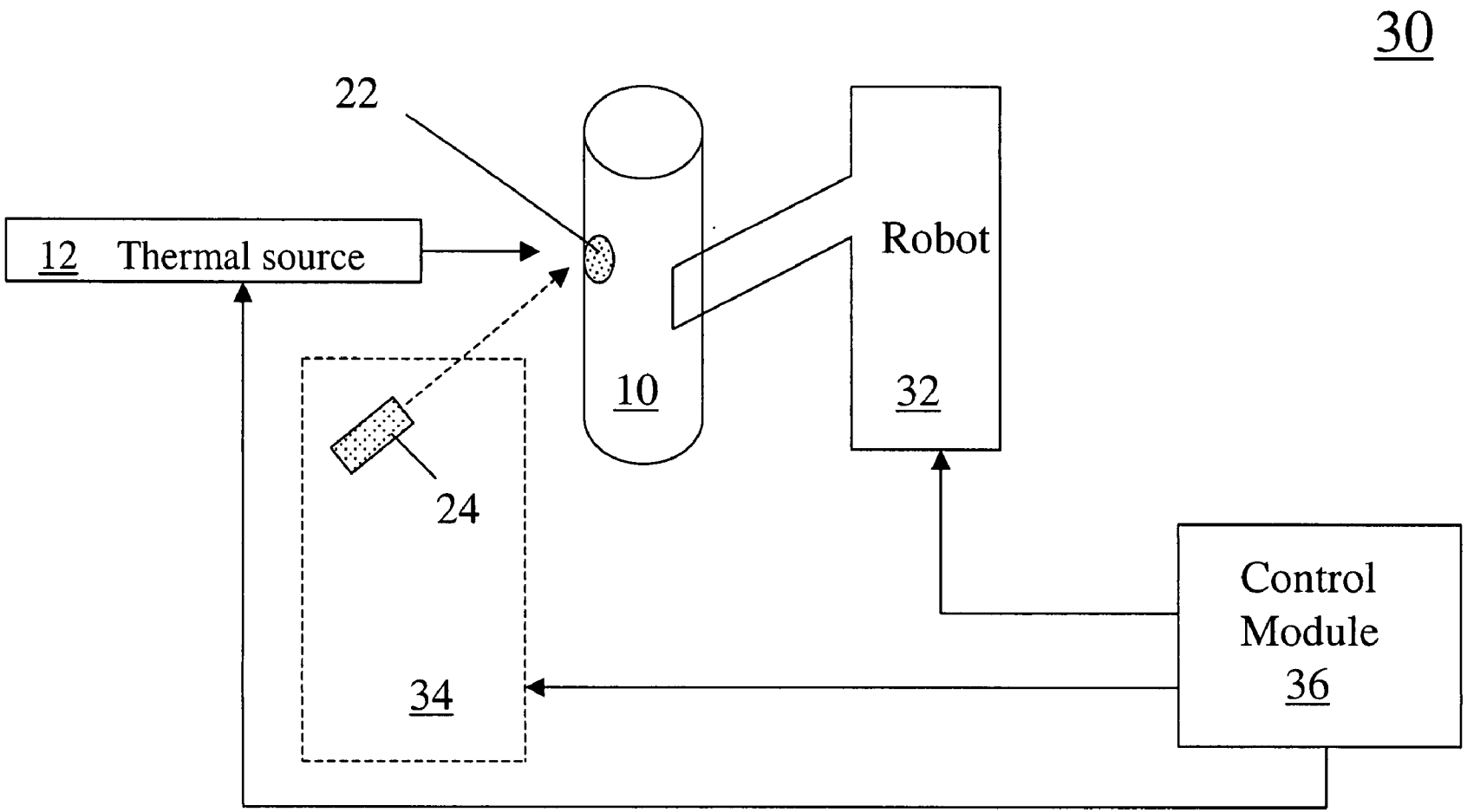
FIG. 7 illustrates another active cooling embodiment of the invention that incorporates liquid (or gas) spray cooling.
Figure 8:
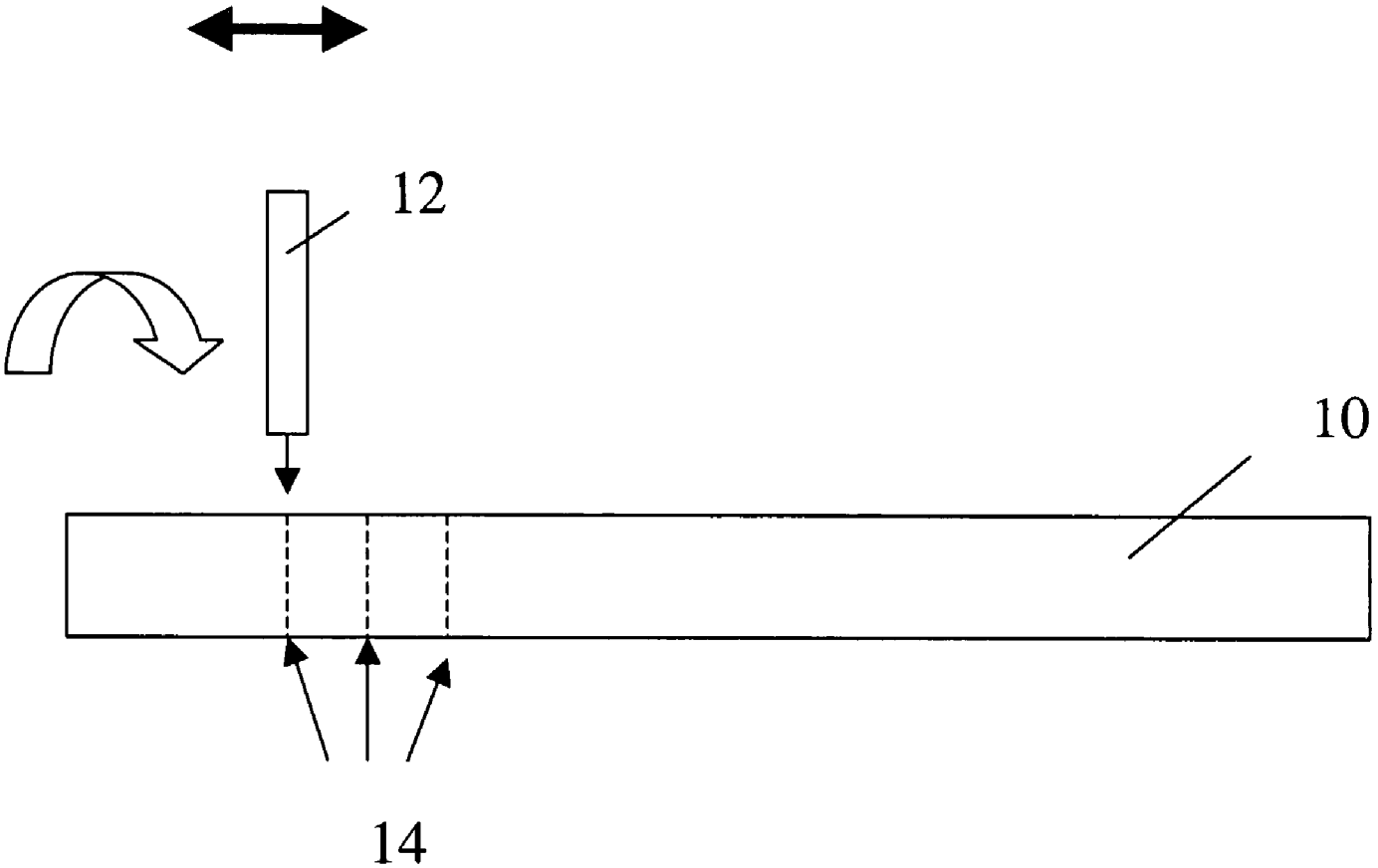
FIG. 8 depicts a thermal source and a tube configured to move both circumferentially and translationally relative to one another.

A system embodiment of the invention is described with reference to FIGS. 1–8. As shown for example in FIG. 1, the system 30 for bending a tube 10 in a pre-selected geometry includes a thermal source 12 configured for heating at least one region 22 along a circumferentially directed path 14 on the tube. Example circumferentially directed paths 14 are indicated in FIG. 8. The circumferentially directed paths can have varying arc lengths from short segments to segments encompassing the entire tube circumference. As used herein, the phrase "circumferentially directed" paths should be understood to encompass both normal (90 degrees relative to the tube central axis) and oblique (0 to <90 degrees to the tube central axis) paths. According to a particular embodiment, the thermal source 12 comprises a laser 12. Exemplary lasers 12 include CW and pulsed lasers, and the present invention is not limited to any specific type of laser. Other exemplary thermal sources 12 include, without limitation, an induction heating system, a plasma arc source, a high power infrared arc lamp heating system and a resistance heating source. The system 30 further includes a tube advancing module 32 for advancing the tube 10 and an active cooling module 34 configured for cooling the tube 10 to a pre-selected temperature. According to a particular embodiment, the pre-selected temperature is room temperature. The system 30 further includes a control module 36 configured to control the thermal source 12 and the active cooling module 34 to alternately heat the tube 10 along the circumferentially directed path 14 and to cool the tube 10 to the pre-selected temperature. A processing module 40 is configured to derive at least one processing parameter from the pre-selected geometry. The system 30 is configured to perform the alternate heating and cooling steps repeatedly.

As used herein, the terms "tube" and "tubular workpiece" are interchangeable. Tubes may be initially straight, and tubes also can be pre-bent. A pre-bent tube can be an in-process tube that is being thermally formed or a tube presented for repair, such as one that has undergone mechanical bending and requires thermal forming to bring it into final tolerance The rotation rate and thermal energy level can vary with rotational position and axial position. Paths at a particular axial position can be repeated several times to intensify the local deformation before advancing to a new axial position. For gradual bending, in general, the thermal energy is spread over many circumferentially directed paths spaced along the tube.

Beneficially, the active cooling module 34 cools the tube 10 to the pre-selected temperature in a short time. For example, by quench cooling the tube 10 in a liquid bath 28, the tube 10 is brought to room temperature in less than about one second. An example liquid bath 28 is a room-temperature liquid bath. In contrast, for conventional air-cooling, several minutes are required for the tube 10 to cool to room temperature. This dramatically shortened cooling time reduces cycle time, as the heating and cooling operations are performed repeatedly. In addition, the active cooling also in many cases increases the efficiency of the upset mechanism and subsequent development of bending.

The processing module 40 is equipped with the necessary software and hardware to determine at least one processing parameter based on the pre-selected geometry (i.e., the desired final shape). For example, the desired final shape may be defined by a computer model or other mathematical representation. One exemplary processing parameter is the sequence of circumferential, axial, or oblique passes to be performed in order to achieve the desired final shape. As discussed below, this sequence may be modified, if required, through the control module 36 using real-time feedback. Other example process parameters include, without limitation, laser power, beam size, rotation speed, coverage angle, step size along the axial direction and cooling time. The processing module 40 may be separate from the control module 36 (as indicated, for example in FIG. 1) or may form an algorithm subunit of control module 36. The appended claims should be understood to encompass both of these embodiments.

Exemplary tube advancing modules 32 include a frictional wheel system (not shown), a linear track system (not shown), a linear feeding system capable of rotating the tube 10 and a robot system. In addition, tube advancing module 32 may be further configured to guide the tube 10. Exemplary guiding means include a mechanical support to balance the weight of the tube, as well as a fluidic support to balance the weight of the tube.

Figure 1:
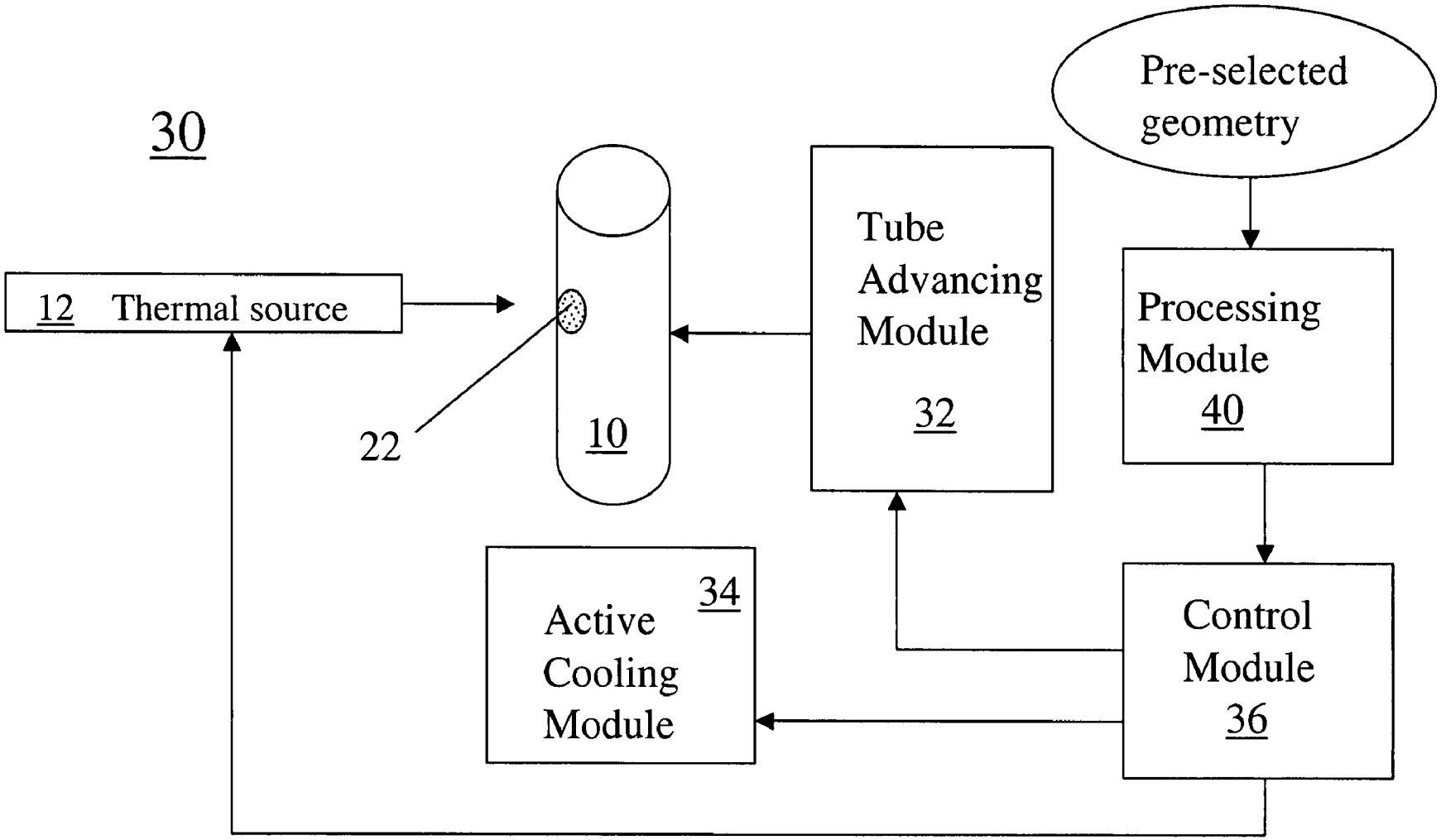
Figure 2:
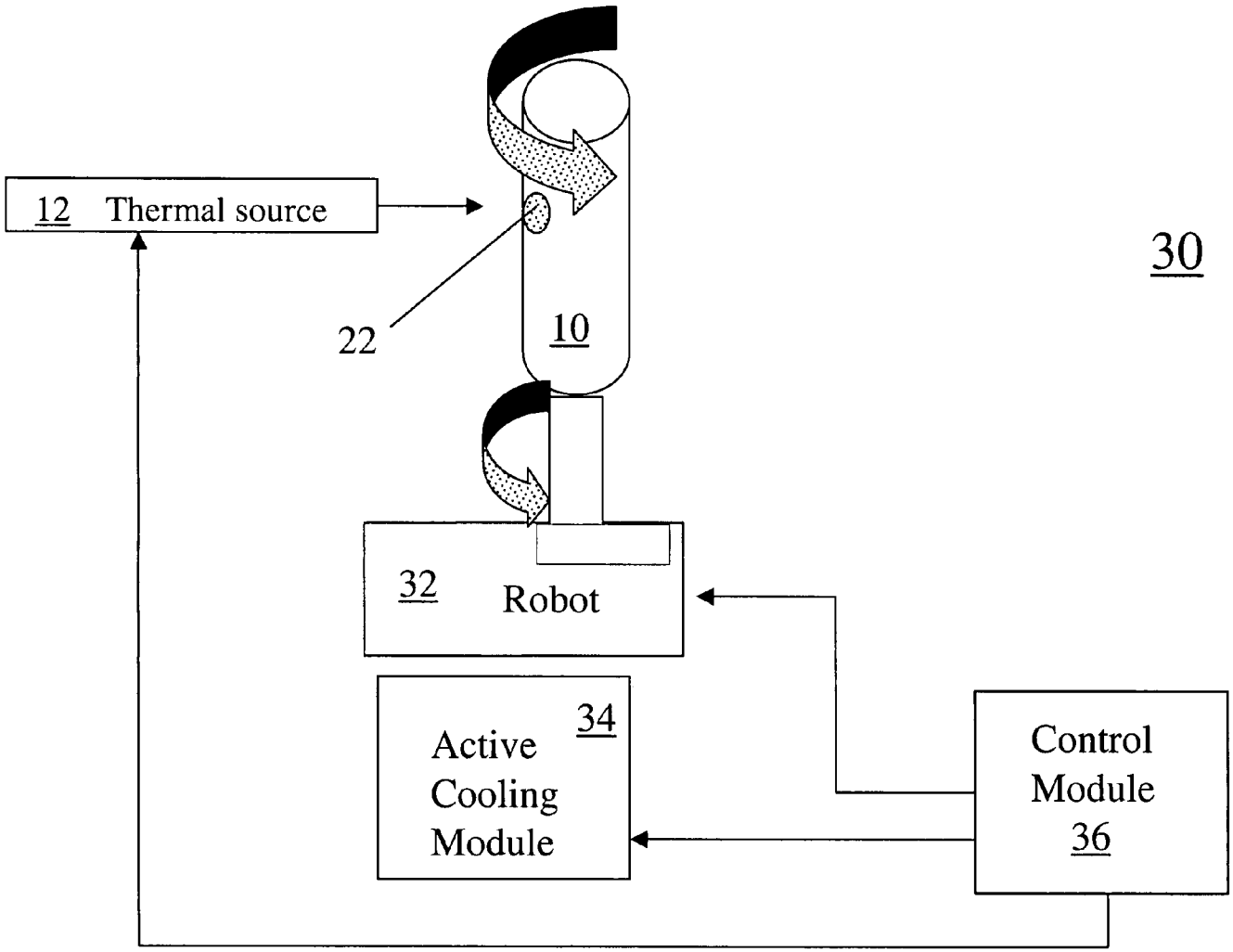
FIG. 2 illustrates a fixed thermal source, rotating tube embodiment of the invention.

To heat the tube 10 along a circumferentially directed path 14, there are many options. In one implementation, the thermal source 12 is fixed, and the tube 10 rotates. This implementation is depicted in FIG. 2. According to a particular implementation, the control module 36 is further configured to control the tube advancing module 32. For the exemplary embodiment shown in FIG. 2, the control module 36 is further configured to provide feedback control to the thermal source 12, tube advancing module 32 and active cooling module 34, and the tube advancing module 32 is configured to rotate the tube 10 in response to the feedback. For example, the geometry change in the region of laser scanning may be monitored to provide feedback based on the detected geometry change. As discussed below, control module 36 may include, as an optional subunit, a geometry monitoring subunit (not shown), which is configured to monitor the geometry change around the region of laser scanning in order to provide feedback based on the detected geometry change. The geometry subunit typically includes one or more sensors, such as laser displacement sensors or dial indicators. Because the bending is localized (i.e., the bending only occurs in the region 22 of laser scanning), the geometry change can be monitored and used for feedback control. Thus, control module 36 enables the realization of both high accuracy and digitally driven laser tube bending. For the exemplary implementation depicted in FIG. 2, the tube advancing module 32 comprises a robot 32, which rotates the tube 10 relative to the thermal source 12. The fixed thermal source, rotating tube implementation of FIG. 2 is useful for short tubes, as well as for small and light weight tubes. For example, a six inch long, half inch diameter metal tube was processed using the system indicated in FIG. 2. A radius of two inches was achieved for 90 degree bending with good surface quality.

Figure 3:
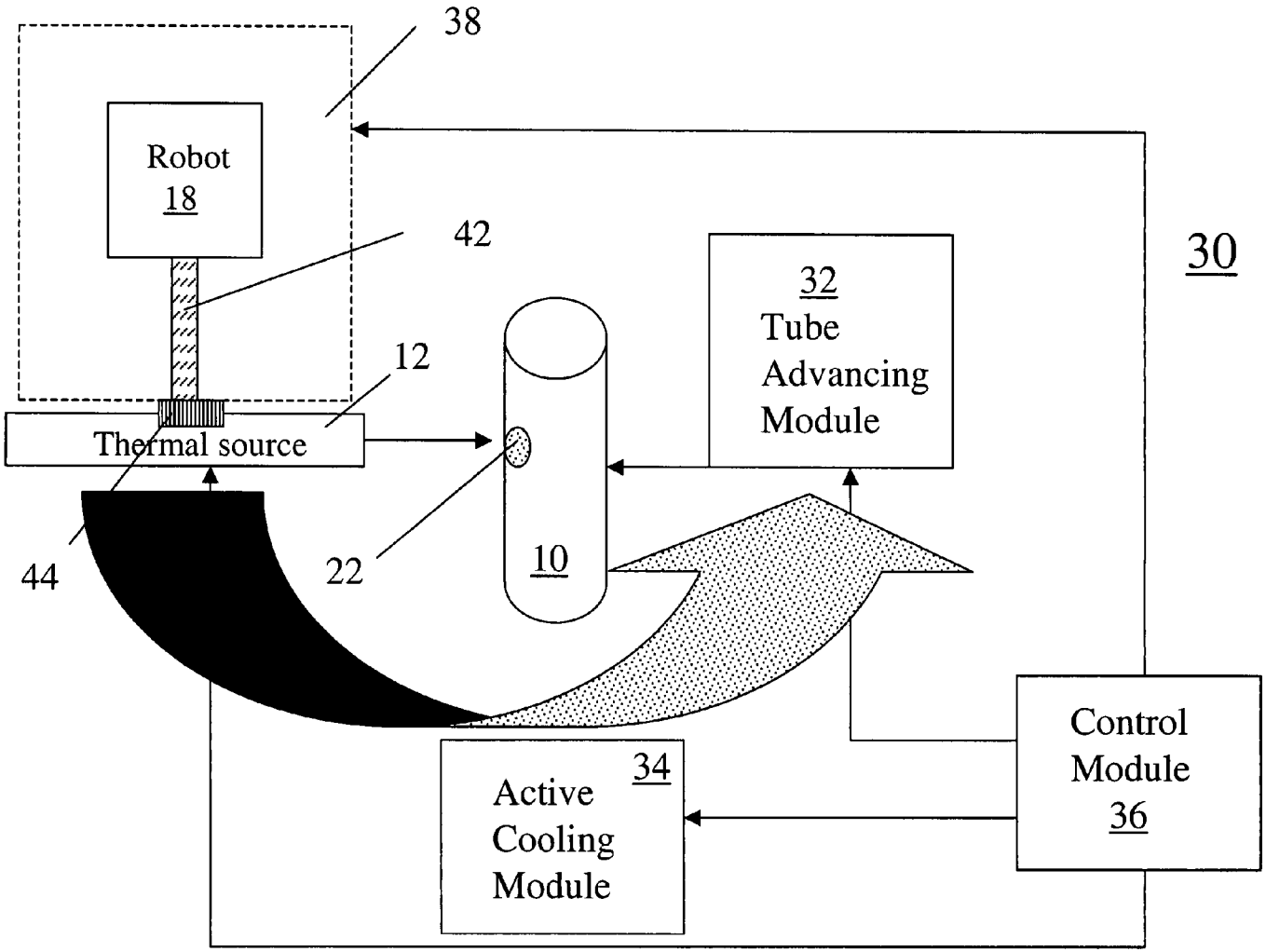
FIG. 3 illustrates one direct thermal source rotation embodiment of the invention.
Figure 4:
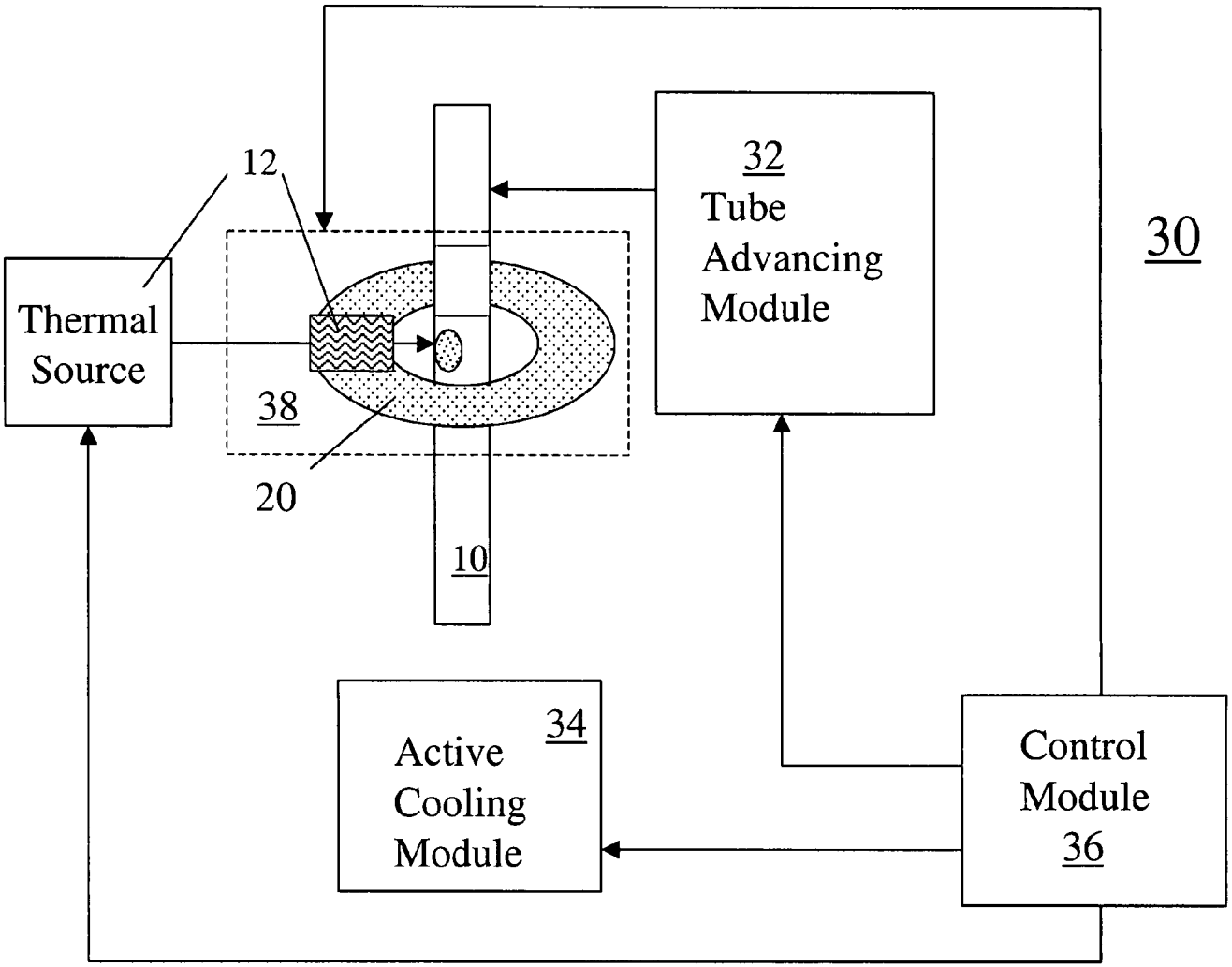
FIG. 4 illustrates another direct thermal source rotation embodiment of the invention.

To bend long tubes or to bend complex geometry tubes, it is beneficial to fix the tube during heating, while the thermal energy is applied circumferentially. Several implementations may be employed, including both direct and indirect rotation of the thermal source. FIGS. 3 and 4 depict two direct thermal source rotation embodiments, and for the exemplary embodiments shown in FIGS. 3 and 4, the system 30 further includes a motion system 38 configured to rotate the thermal source 12 around the tube 10, while keeping the tube 10 fixed or in controlled motion. For the exemplary embodiment depicted in FIG. 3, the motion system 38 includes a multi-axis robot 18 having a movable arm 42. The motion system 38 further includes a mounting fixture 44 affixed to the movable arm 42 for supporting the thermal source 12.

For the exemplary embodiment depicted in FIG. 4, the motion system 38 includes a rotating ring 20 and a mounting fixture (not shown) affixed to the rotating ring 20 for supporting the thermal source 12. For the exemplary embodiment depicted in FIG. 4, the tube 10 passes through the central opening of the rotating ring 20, the thermal source 12 irradiates the tube 10 radially, while the rotating ring 20 rotates the thermal source 12 over a pre-selected angle. To ensure smooth control of motion, a balance weight (not shown) may be employed.

In one example, the thermal source 12 is a Nd:YAG laser or fiber laser with a fiber output head (also indicated by reference numeral 12). The fiber output head 12 is rotated around the tube 10 by motion system 38, for example using the implementation of FIG. 3 or 4. High power direct diode lasers are also suitable for the direct-thermal source rotation approach. Generally, the direct rotation approach of FIGS. 3 and 4 are suitable for laser delivery systems that can tolerate repetitive flexing. This creates a strict requirement for the laser head design because the cable and the fiber connecting the laser head to the laser must be robust. For example, for an angular velocity of 180 degrees/second, robust production can be difficult with the direct rotation approach, in view of the typical mass and the size of the laser head.

Figure 5:
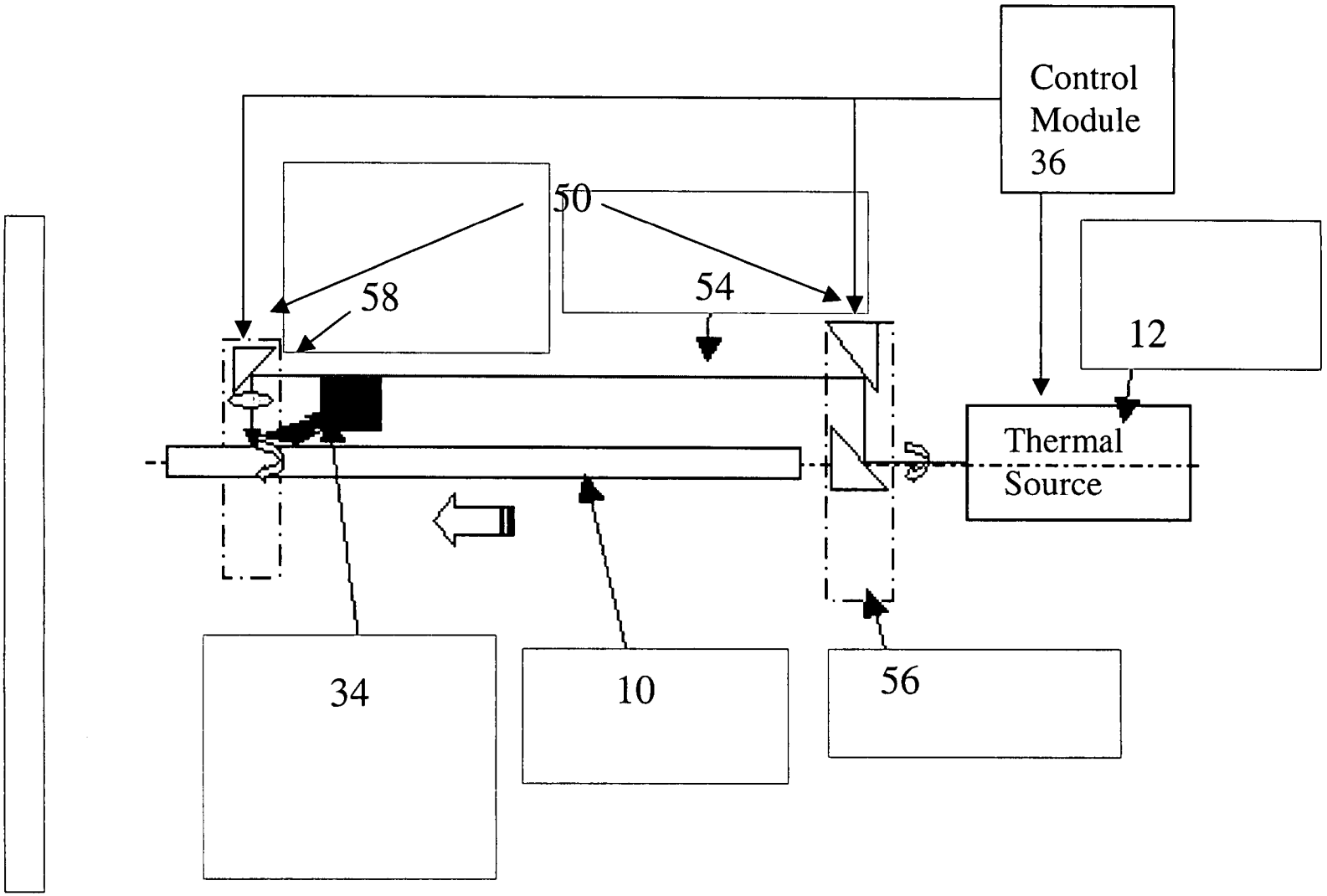
FIG. 5 illustrates an indirect thermal source rotation embodiment of the invention.

FIG. 5 illustrates an indirect rotation approach. For the exemplary embodiment shown in FIG. 5, the system 30 further includes an optical system 50 configured to indirectly rotate the thermal source 12 around the tube 10. According to a more particular embodiment, the control module 36 is further configured to control the rotation of the optical system 50. For the particular implementation shown in FIG. 5, the thermal source 12 is a laser 12 and is fixed and aligned to the central axis of the tube 10. A laser beam 54 is reflected by a first optical unit 56. The laser beam 54 then propagates until it is reflected and focused by a second optical unit 58 and then irradiates the tube 10. Each of the optical units 56, 58 may include one or more mirrors, as well as lenses for focusing the beam. As the laser 12 is aligned with the central axis of the tube 10, synchronized rotation of optical units 56, 58 can deliver laser energy over any angle of the tube without moving the laser 12. After each scan, the tube is cooled by active cooling module 34 and then either the tube is advanced or the optical unit 58 is advanced for the next scan.

Several approaches can be employed to actively cool the tube 10 after being heated by the thermal source 12. It should be noted that although these approaches are shown in FIGS. 6 and 7 for the tube rotating embodiment described above with reference to FIG. 2, these active cooling techniques are equally applicable to both the direct and indirect laser rotating embodiments described above with reference to FIGS. 3, 4 and 5. For the exemplary embodiment depicted in FIG. 6, the active cooling module 34 comprises a liquid bath 28 configured to receive the tube 10. Exemplary liquids for use in liquid bath 28 include, without limitation, water, liquid argon, liquid nitrogen, as well as solutions with corrosion-resistant reagent. For this embodiment, the tube advancing module 32 is configured to move the tube 10 into and out of the liquid bath 28, and the control module 36 is configured to control the movement of the tube 10 by the tube advancing module 32. According to a particular embodiment, the active cooling module 34 further includes a liquid spray source 24 configured for intermittent spray cooling of the tube 10. In other embodiments, reference numeral 28 in FIG. 6 represents a fluidized particle bed and/or an initially solid coolant. For the fluidized particle bed embodiment, exemplary particles are formed of copper or another high thermal conductivity metal, and the particles (not shown) provide conductive cooling of the tube 10. For the initially solid coolant embodiment, the coolant is a solid that melts, for example ice or fat. The transformation of solid to liquid absorbs energy from the tube 10, thereby cooling the tube 10.

Another active cooling approach is schematically depicted in FIG. 7. For the exemplary embodiment shown in FIG. 7, the active cooling module 34 comprises a liquid spray source 24 configured for spray cooling the tube 10. Exemplary liquids for use with liquid source 24 include, without limitation, water, liquid argon, and liquid nitrogen. For the exemplary embodiment shown in FIG. 7, the liquid spray source 24 sprays a water jet at the heated region 22 on the tube 10. Liquid spray source may further be configured to spray relatively soft solid coolants onto the tube 10. As noted above, the solid coolants cool the tube 10 by transformation to a liquid.

For another implementation, the active cooling module 34 comprises a gas spray source (also indicated by reference numeral 24 in FIG. 7) configured for spray cooling the tube 10. For the exemplary embodiment shown in FIG. 7, gas spray source 24 sprays a gas jet at the heated region 22 on the tube 10. Exemplary gases for use with gas source 24 include, without limitation, low temperature compressed air, argon, and nitrogen.

According to a particular embodiment, the control module 36 comprises a number of subunits (not shown). Exemplary control subunits include a control subunit configured to synchronize the laser firing, tube advancing and laser energy scanning operations. As used herein, the term "configured" should be understood to describe a component that achieves a desired output by employing the appropriate hardware and software. Other exemplary control subunits include a geometry monitoring subunit, which is configured to monitor the geometry change around the region of laser scanning in order to provide feedback based on the detected geometry change, and an algorithm subunit to determine processing parameters. Example process parameters include laser power, beam size and rotation speed. For this exemplary embodiment, control module 36 provides both high accuracy and digitally driven laser tube bending.

According to a more particular embodiment, the relation between the bending angle and the process parameters is determined by performing a design of experiment (DOE). Example process parameters include laser power, beam size, rotation speed, coverage angle, step size along the axial direction and cooling time. The transfer function and/or look-up table(s) is derived from the DOE and is used to control the laser tube bending process. By changing the location of the laser scanning, the direction of the tube bending can be readily changed. Thus, by using control module 36 to synchronize laser firing, energy deposition and the motion of the tube, 3D tube bending can be realized using the present technique. Consequently, the designer is limited only by the achievable bending radius, when using the present technique.

Beneficially, the present technique is applicable to both macro-scale and micro-scale tube bending. The present technique provides improved accuracy, 3D capability, and enhanced flexibility in the design of engineering tubes. The present technique enables tube bending that would be impossible using mechanical bending, such as 3D transitional tube bending. The present technique also provides reduced wall thinning and tube cross-sectional geometry deformation, reduced spring-back and an improved level of repeatability with lower variance. The present technique controls surface quality more easily than with axial scanning, and can bend a straight tube into a smaller radius than achievable using axial scanning. Moreover, the present technique does not require hard tooling to produce deformation, thereby reducing tooling and fixture costs, as well as set-up time. In addition the present technique can desirably be CAD driven and automated.

Figure 9:
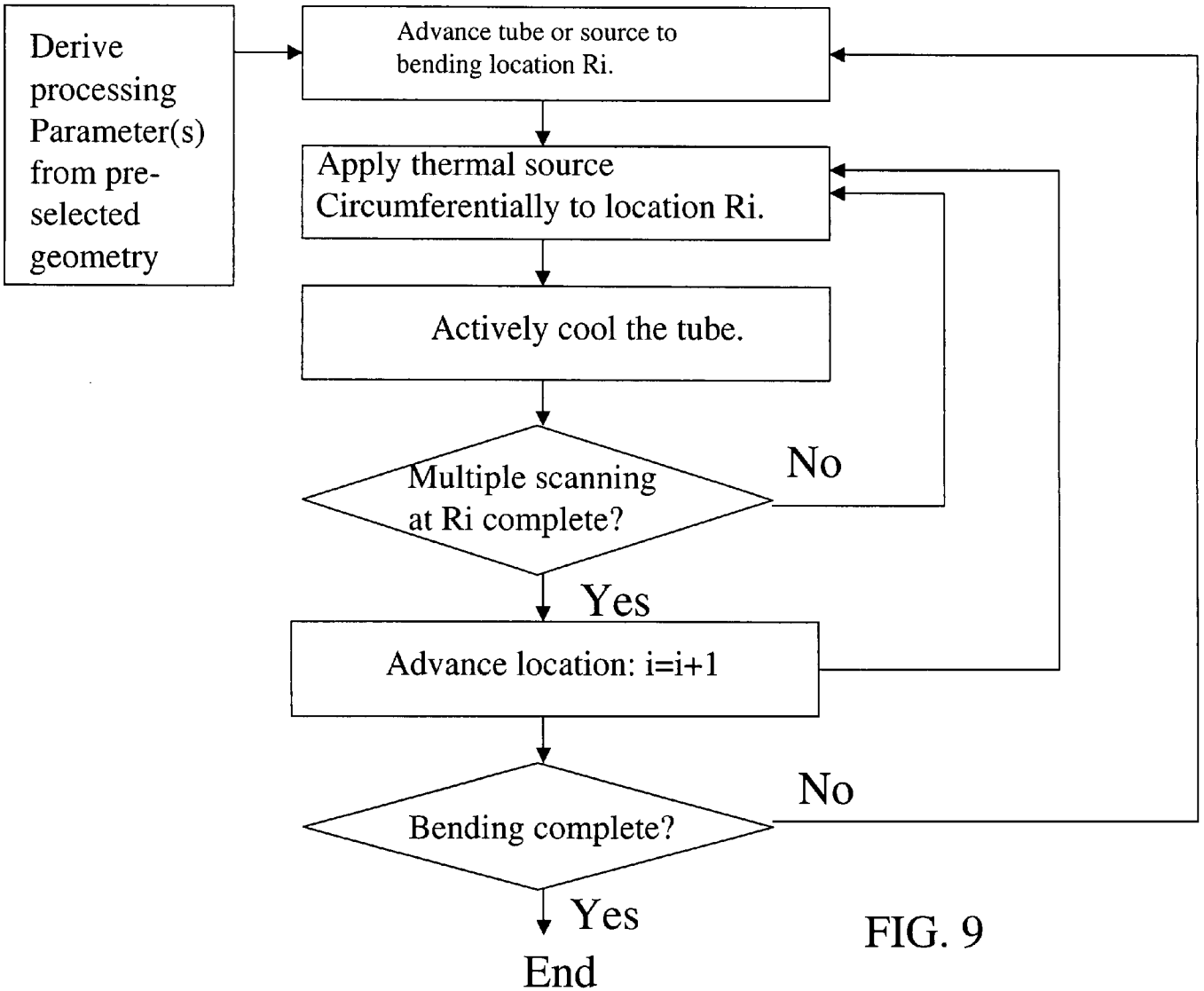
FIG. 9 is a flow chart illustrating a method embodiment of the invention.

A method embodiment of the invention is described with reference to FIG. 9. As indicated, for example, in FIG. 9, the method for bending a tube 10 in a pre-selected geometry includes the steps of deriving at least one processing parameter from the pre-selected geometry, applying a thermal source 12 circumferentially to the tube 10 to heat the tube 10 along at least one circumferentially directed path 14 in accordance with the at least one processing parameter and actively cooling the tube 10 to a pre-selected temperature. One exemplary pre-selected temperature is room temperature. The applying and active cooling steps are alternately performed a number of times to heat the tube 10 along the circumferentially directed path 14 and to repeatedly actively cool the tube 10 to the pre-selected temperature. According to a particular embodiment, the applying step is performed at a number of locations 16 along the circumferentially directed path 14. In addition to rotating the thermal source 12 relative to the tube 10, the method may further include translationally moving the thermal source 12 relative to the tube 10 and repeating the applying and active cooling steps for at least one additional circumferentially directed path, as schematically indicated in FIG. 8, for example.

Example processing parameters include, without limitation, the sequence of circumferential, axial, or oblique passes to be performed in order to achieve the desired final shape. As discussed above and in accordance with a particular embodiment, the relation between the desired bending angle and the process parameters may be determined by performing a design of experiment (DOE). This relation can be characterized by a transfer function or look up table(s), for example. A processing module 40 (which can be separate from the control module 36 or may be included as an algorithm subunit thereof) is equipped with the necessary software and hardware to implement the transfer function or look up table(s) in order to automatically determine the processing parameters based on a pre-selected tube bending geometry.

As noted above, an exemplary thermal source 12 is a laser 12, non-limiting examples of which include CW and pulsed lasers. Other exemplary thermal sources include, without limitation, an induction heating system, a plasma arc source (such as a high power infrared arc lamp heating system) and a resistance heat source.

For the exemplary embodiment schematically shown in FIG. 2, the applying step includes rotating the tube 10 to heat the tube along the circumferentially directed path 14. For the particular embodiment of FIG. 2, the rotating step comprises rotating the tube using a robot 18. As noted above, this embodiment is useful for short tubes, as well as for small and light weight tubes.

For the exemplary embodiments schematically shown in FIGS. 3, 4 and 5, the applying step includes rotating the thermal source 12 around the tube 10 to heat the tube 10 along the circumferentially directed path 14. For the exemplary embodiments of FIGS. 3 and 4, the thermal source 12 is rotated directly. In particular, the thermal source is rotated using a robot 18, for the exemplary embodiment depicted in FIG. 3. The thermal source is rotated using a rotating ring 20, for the exemplary embodiment depicted in FIG. 4. As discussed above, these direct source rotation embodiments are suitable for laser delivery systems that can tolerate repetitive flexing.

FIG. 5 illustrates a more robust, indirect source rotation implementation. For the exemplary embodiment of FIG. 5, the thermal source 12 is rotated indirectly using optical units 56, 58. Beneficially, synchronized rotation of optical units 56, 58 can deliver laser energy over any angle of the tube without moving the laser 12 because the laser 12 is aligned with the central axis of the tube 10.

The present technique encompasses a variety of active cooling techniques. In one implementation, the active cooling step includes quenching the tube 10 in a liquid 28. This embodiment is indicated in FIG. 6, for example. For example, the tube 10 may be entirely or partially immersed in water. For the partial immersion embodiment, the portion of the tube 10 that was heated by the thermal source is immersed in the liquid 28. According to a more particular embodiment, the active cooling further includes intermittent spray cooling, using a water or other liquid jet 24, for example. This embodiment is shown in FIG. 6.

FIG. 7 illustrates another active cooling embodiment. For the exemplary embodiment shown in FIG. 7, the active cooling comprises applying a liquid jet 24 to a heated region 22 of the tube 10. According to another embodiment, the active cooling comprises applying a gas jet 26 to a heated region 22 of the tube 10. This embodiment is also illustrated by FIG. 7. As noted above, the active cooling significantly reduces cycle time relative to conventional air cooling.

Although only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for bending a tube, the method comprising the steps of:

deriving a relation between a desired bending angle and at least one processing parameter;

applying a thermal source to at least one region of the tube to heat the tube along at least one circumferentially directed path in accordance with the at least one processing parameter; and actively cooling the tube to a pre-selected temperature, wherein the applying and active cooling steps are alternately performed a plurality of times to heat the tube along the circumferentially directed path and to repeatedly actively cool the tube to the pre-selected temperature.

2. The method of claim 1, wherein the applying step comprises rotating the tube to heat the tube along the circumferentially directed path.

3. The method of claim 2, wherein said rotating step comprises rotating the tube using a robot.

4. The method of claim 1, wherein said applying step is performed at a plurality of locations along the circumferentially directed path.

5. The method of claim 1, wherein said applying step comprises rotating the thermal source around the tube to heat the tube along the circumferentially directed path.

6. The method of claim 5, wherein the thermal source is rotated directly.

7. The method of claim 6, wherein the thermal source is rotated using a robot.

8. The method of claim 6, wherein the thermal source is rotated using a rotating ring.

9. The method of claim 5, wherein the thermal source is rotated indirectly.

10. The method of claim 1, wherein the thermal source comprises a laser.

11. The method of claim 1, wherein said active cooling comprises quenching the tube in a liquid.

12. The method of claim 11, wherein said active cooling further comprises intermittent spray cooling.

13. The method of claim 1, wherein said active cooling comprises applying a liquid jet to the at least one region of the tube.

14. The method of claim 1, wherein said active cooling comprises applying a gas jet to the at least one region of the tube.

15. The method of claim 1, wherein said active cooling comprises quenching the tube in a fluidized particle bed.

16. The method of claim 1, wherein said active cooling comprises quenching the tube in an initially solid coolant.

17. The method of claim 1, further comprising translationally moving the thermal source relative to the tube and repeating said applying and active cooling steps for at least one additional circumferentially directed path.

18. The method of claim 1, wherein the at least one processing parameter is selected from the group consisting of a sequence of passes to be performed in order to achieve the desired bending angle, a thermal source power, a thermal source beam size, a rotation speed, a coverage angle, a step size along an axial direction and a cooling time.

19. A system for bending a tube, comprising:

a thermal source configured for heating at least one region along a circumferentially directed path on the tube;

a tube advancing module for advancing the tube;

an active cooling module configured for cooling the tube to a pre-selected temperature;

a processing module configured to derive at least one processing parameter based on the desired bending angle; and a control module configured to control said thermal source and active cooling module in accordance with the at least one processing parameter to alternately heat the tube along the circumferentially directed path and to cool the tube to the pre-selected temperature, wherein the alternate heating and cooling are performed a plurality of times.

20. The system of claim 19, wherein said control module is further configured to control said tube advancing module in accordance with the at least one processing parameter.

21. The system of claim 20, wherein said control module is further configured to provide feedback control to said thermal source, said tube advancing module and said active cooling module, and wherein said tube advancing module is configured to rotate the tube in response to the feedback.

22. The system of claim 19, further comprising a motion system configured to rotate said thermal source around the tube.

23. The system of claim 22, wherein said motion system comprises:

a robot comprising a movable arm; and a mounting fixture affixed to said movable arm for supporting said thermal source.

24. The system of claim 22, wherein said motion system comprises:

a rotating ring; and a mounting fixture affixed to said rotating ring for supporting said thermal source.

25. The system of claim 19, further comprising an optical system configured to indirectly rotate the thermal source around the tube.

26. The system of claim 25, wherein said control module is further configured to control the rotation of said optical system.

27. The system of claim 19, wherein said thermal source comprises a laser.

28. The system of claim 20, wherein said active cooling module comprises a liquid bath configured to receive the tube, wherein said tube advancing module is configured to move the tube into and out of said liquid bath, and wherein said control module is configured to control the movement of the tube by said tube advancing module.

29. The system of claim 28, wherein said active cooling module further comprises a liquid spray source configured for intermittent spray cooling of the tube.

30. The system of claim 20, wherein said active cooling module comprises a fluidized particle bed configured to receive the tube, wherein said tube advancing module is configured to move the tube into and out of said liquid bath, and wherein said control module is configured to control the movement of the tube by said tube advancing module.

31. The system of claim 20, wherein said active cooling module comprises an initially solid coolant configured to receive the tube, wherein said tube advancing module is configured to move the tube into and out of said liquid bath, and wherein said control module is configured to control the movement of the tube by said tube advancing module.

32. The system of claim 19, wherein said active cooling module comprises a liquid spray source configured for spray cooling the tube.

33. The system of claim 19, wherein said active cooling module comprises a gas spray source configured for spray cooling the tube.

34. The system of claim 19, wherein the at least one processing parameter is selected from the group consisting of a sequence of passes to be performed in order to achieve the desired bending angle, a thermal source power, a thermal source beam size, a rotation speed, a coverage angle, a step size along an axial direction and a cooling time.

* * * * *